United States Patent [19]

Hilty

[11] 4,363,366

[45] Dec. 14, 1982

[54] SCREENED HOLLOW STEM AUGER FOR USE IN WELL DRILLING AND TESTING PROCESS

[75] Inventor: Robert D. Hilty, Williamston, Mich.

[73] Assignee: Keck Consulting Services, Inc., East Lansing, Mich.

[21] Appl. No.: 159,042

[22] Filed: Jun. 13, 1980

[51] Int. Cl.[3] ..... E21B 17/22; E21B 43/08

[52] U.S. Cl. ..... 175/314; 175/394

[58] Field of Search ..... 175/314, 312, 317, 394

[56] References Cited

U.S. PATENT DOCUMENTS

| | | | |
|---|---|---|---|
| 2,513,944 | 7/1950 | Kessler | 175/314 |
| 2,603,319 | 7/1952 | Dyche | 175/394 |
| 2,665,886 | 1/1954 | Ellis | 175/314 |
| 2,856,158 | 10/1958 | Richardson et al. | 175/394 |
| 3,168,924 | 2/1965 | Anderson | 175/314 |
| 3,902,323 | 9/1975 | Watanabe | 175/314 X |
| 3,915,246 | 10/1975 | Sheshtawy | 175/317 |
| 3,986,570 | 10/1976 | Stinson | 175/394 |

FOREIGN PATENT DOCUMENTS

| | | | |
|---|---|---|---|
| 836748 | 10/1938 | France | 175/314 |

*Primary Examiner*—William F. Pate, III

*Attorney, Agent, or Firm*—Miller, Morriss and Pappas

[57] ABSTRACT

A vertically oriented screened hollow stem auger element for use in the simultaneous drilling and testing of wells so as to detect and monitor the existence of hazardous and toxic waste at subsurface levels. The screened hollow stem auger comprises an elongate cylindrical hollow body member having a longitudinal axial bore therethrough. The screened hollow stem auger is adapted at its opposite ends for selective lockable end to end engagement with solid wall hollow stem auger elements and other drilling components for use in the simultaneous drilling and testing of wells. The cylindrical wall of the hollow stem auger element is provided with a central screened portion in open communication with the bore thereof which permits the selective intake of ground fluids into the interior of the screened hollow stem auger element for selective conveyance through the interconnected solid wall hollow stem auger elements to the surface level for testing purposes. A continuous auger flight element is provided on the external surface of the screened hollow stem auger element so as to extend longitudinally therealong across the central screened portion thereof. The lower end portion of the screened hollow stem auger is adapted for selective attachment of drilling bits and pressure grouting valves thereto. The upper end portion of the screened hollow stem auger element is adapted for selective end to end engagement of vertically oriented solid wall hollow stem auger elements thereto as the drilling of a well progresses. Each of the solid wall hollow stem auger elements have a continuous bore therethrough and are also provided with a continuous auger flight element along the external surface thereof. Means are provided for insertion through the continuous bore formed through the interconnected solid wall hollow stem auger elements from the upper ground surface level to the lowermost screened hollow stem auger so as to selectively draw water, contaminated water or other fluid samples from the earth at the drilling level of the screened auger through the screened portion thereof and return them to the upper ground surface level in order to test for the existence of hazardous and toxic waste at various subsurface levels.

5 Claims, 4 Drawing Figures

SCREENED HOLLOW STEM AUGER FOR USE IN WELL DRILLING AND TESTING PROCESS

This invention relates to a vertically oriented screened hollow stem auger element for use in the simultaneous drilling and testing of wells so as to detect and monitor the existence of hazardous and toxic waste at subsurface levels. More specifically, this invention relates to an apparatus and process for the simultaneous drilling and testing of wells whereby fluid samples can be taken at predetermined drilling levels through the screened portion of the lowermost screened hollow stem auger element and selectively delivered to the upper ground surface for testing of water, contaminated water or other fluids contained in the subsurface unconsolidated formations or aquifers through which the test well is being drilled. The screened hollow stem auger comprises an elongate cylindrical hollow body member having a longitudinal axial bore therethrough. The screened hollow stem auger is adapted at its opposite ends for selective lockable end to end engagement with solid wall hollow stem auger elements and other drilling components for use in the simultaneous drilling and testing of wells. The cylindrical wall of the hollow stem auger element is provided with a central screened portion in open communication with the bore thereof which permits the selective intake of ground fluids into the interior of the screened hollow stem auger element for selective conveyance through the interconnected solid wall hollow stem auger elements to the surface level for testing purposes. A continuous auger flight element is provided on the external surface of the screened hollow stem auger element so as to extend longitudinally therealong across the central screened portion thereof. The lower end portion of the screened hollow stem auger is adapted for selective attachment of drilling bits and pressure grouting valves thereto. The upper end portion of the screened hollow stem auger element is adapted for selective end to end engagement of vertically oriented solid wall hollow stem auger elements thereto as the drilling of a well progresses. Each of the solid wall hollow stem auger elements have a continuous bore therethrough and are also provided with a continuous auger flight element along the external surface thereof.

Continuous pumping and delivery means are provided for insertion through the continuous bore formed through the interconnected solid wall hollow stem auger elements from the upper ground level to the lowermost screened hollow stem auger so as to selectively draw fluid samples from the earth at the drilling level of the screened hollow stem auger through the screened portion thereof and return them to the upper ground level for selective testing of the quality or quantity of the fluid sample taken at each interval or drilling level.

It is thus seen that an apparatus and process for the simultaneous drilling and testing of wells is provided whereby fluid samples can be taken at predetermined drilling levels in order to detect and monitor the existence of hazardous and toxic waste in the subsurface unconsolidated formations or aquifers.

It is therefore an object of this invention to provide an apparatus and process for the simultaneous drilling and testing of wells whereby the existence of hazardous and toxic waste at subsurface levels can be easily, quickly and economically detected and monitored.

Other objects and advantages found in the construction of the invention will be apparent from a consideration of the following specification in connection with the appended claims and the accompanying drawings.

IN THE DRAWINGS

SPECIFIC DESCRIPTION

Figure 1:
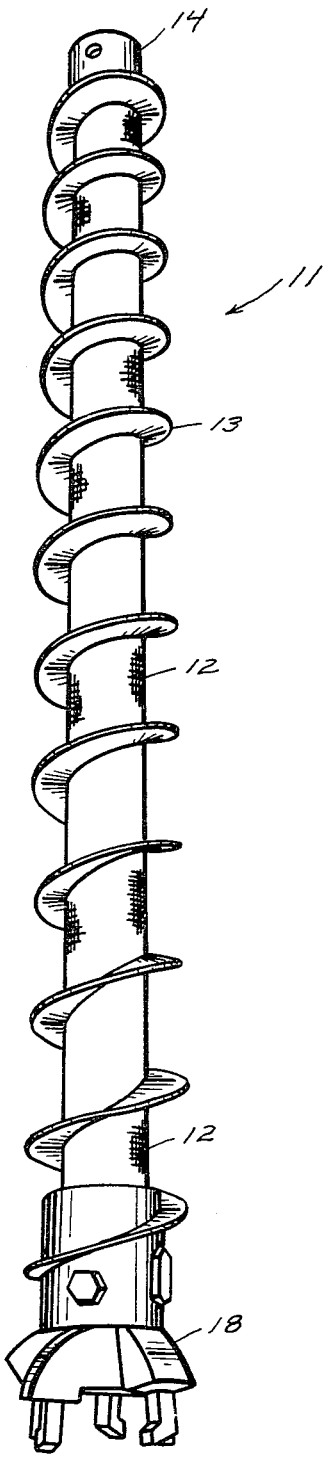
FIG. 1 is a perspective view of the screened hollow stem auger showing the central continuous wire-wound screened portion thereof and the continuous auger flight element provided on the external surface thereof.
Figure 2:
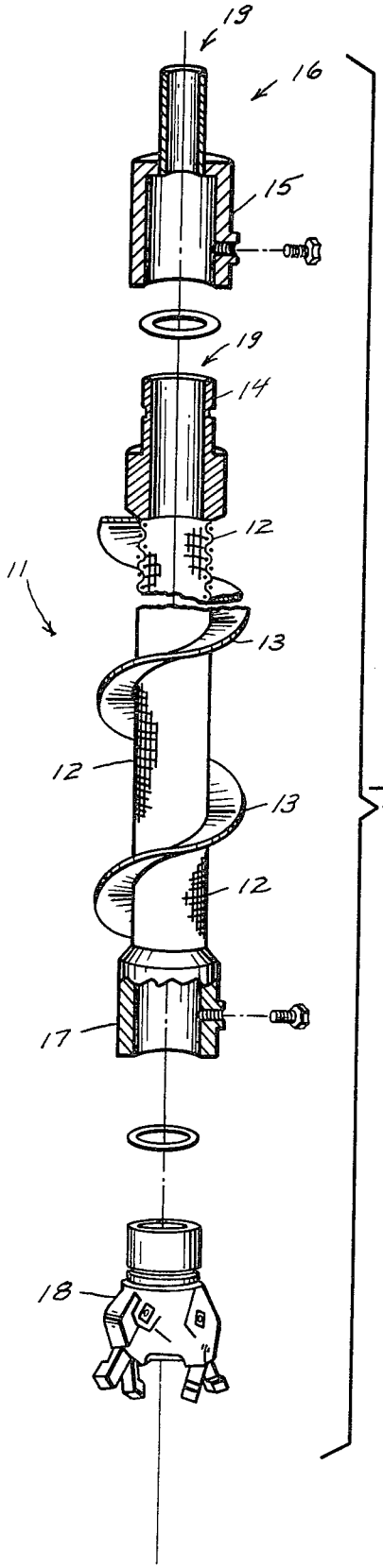
FIG. 2 is a front elevational exploded schematic cross-sectional view of the screened hollow stem auger showing the central continuous wire-wound screened wall portion thereof and end portions thereof which are adapted for selective interconnection with solid wall hollow stem augers and drilling components.

As shown generally in the drawings and more specifically in FIGS. 1 and 2, the screened hollow stem auger 11 is provided with a central continuous wire wound screened portion 12. A continuous auger flight element 13 is provided on the external surface of the screened hollow stem auger element 11 so as to extend longitudinally therealong across the central screened portion 12 thereof. The upper end portion of the hollow stem auger 11 is provided with a male connector tubular extension 14 which is adapted for lockable and mating end to end engagement with the lower female connector portion 15 of a solid wall hollow stem auger element 16 positioned thereabove, as shown in the exploded schematic view of FIG. 2. The upper end portion of each solid wall hollow stem auger is provided with a tubular male extension (not shown) so as to provide for lockable end to end engagement with other solid wall hollow stem augers 15 as described hereafter. The lower end of the screened hollow stem auger 11 is provided with a female connector portion 17 which is adapted for selective lockable engagement with standard well drilling components, such as drilling bits 18, grouting valve assemblies (not shown) and the like. A closure plug (not shown) can also be inserted within the female connector portion 17 of the screened hollow stem auger 11 so as to effect bottom closure of the hollow stem auger 11 if desired when drilling components are not connected thereto.

Although male extension 14 and female connector 17 elements are described herein for selective lockable engagement with solid wall hollow stem augers 16 and drilling components 18, respectively, it is within the scope of the invention to utilize other types of coupling or retaining configurations that are well known in the art to accomplish the foregoing.

As described herein, it is thus seen that the screened hollow stem auger 11 consists of an elongate cylindrical hollow stem body member defining a longitudinal axial bore 19 therethrough. Each of the solid wall hollow stem auger elements 16 used in connection with the screened hollow stem auger 11 also has an elongate cylindrical hollow tubular configuration having a continuous bore 19 therethrough and is also provided with a continuous auger flight element 13 along the external surface thereof.

Figure 3:
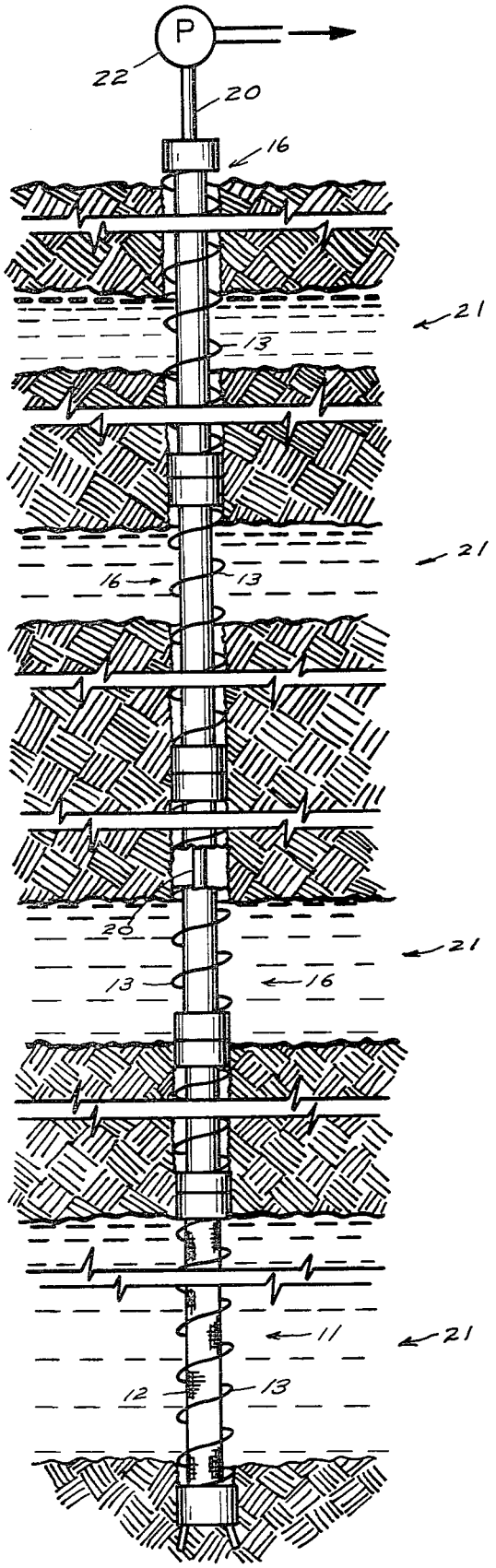
FIG. 3 is a schematic view of the vertically screened hollow stem auger member assembly including the solid wall hollow stem auger elements interconnected therewith to form the apparatus for the simultaneous drilling and testing of a well.

In operation, the screened hollow stem auger 11 is provided with a drill bit 18 at the lower end 17 thereof and the drilling of a test well is started. As shown in FIG. 3, as the drilling progresses, additional solid wall hollow stem auger elements 16 are provided in selective lockable end to end engagement with the lowermost lead screened hollow stem auger 11 and to each other so as to form a vertically oriented drilling assembly. Thus joined, the solid wall hollow stem auger elements 16 and the screened hollow stem auger 11 cooperate to define a continuous bore 19 from the level being drilled to the surface.

Figure 4:
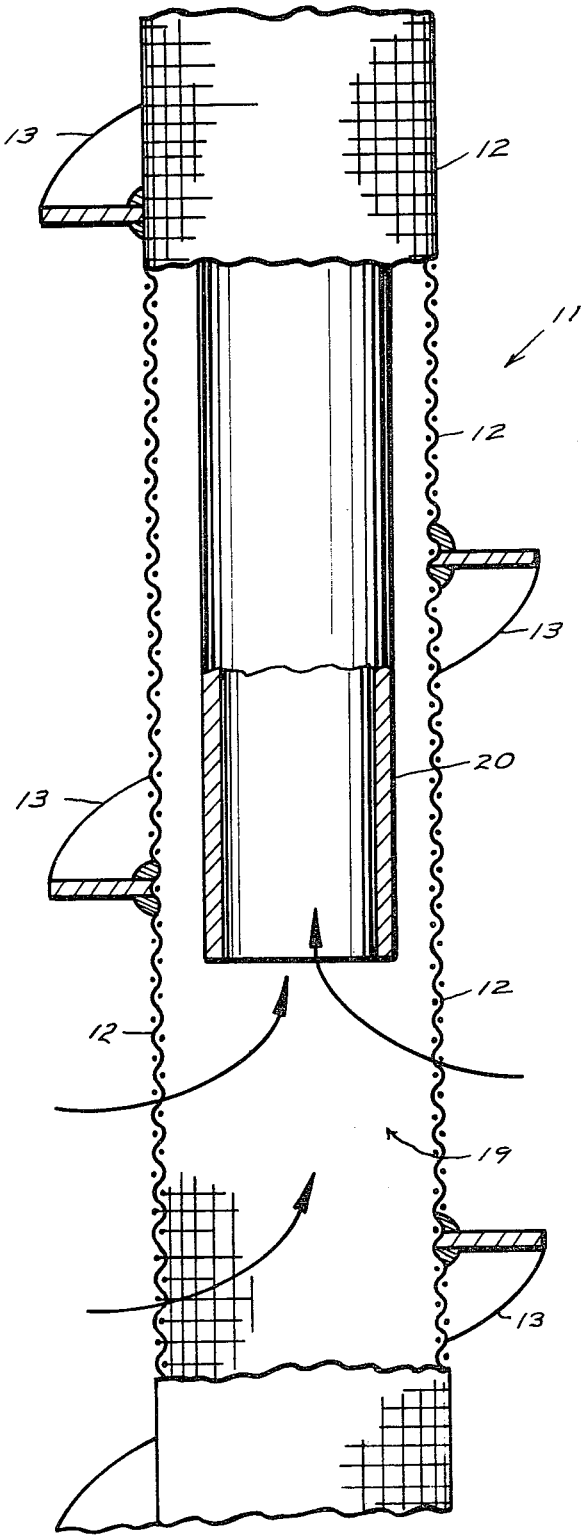
FIG. 4 is an enlarged cross-sectional schematic view of a portion of the screened hollow stem auger showing the selective intake of fluid samples through the screened portion thereof for conveyance to the surface level for testing purposes.

As shown in FIGS. 3 and 4, pipe means 20 are lowered through the continuous bore 19 formed by the interconnected auger elements so as to draw fluid samples to the surface from any desired predetermined drilling level. As shown in FIG. 3, the subsurface generally contains strata of unconsolidated formations or aquifers 21 from which fluid samples can be collected for testing purposes in order to detect and monitor hazardous and toxic waste contained therein. The fluid samples are carried to the surface through the pipe means 20 by use of conventional means for withdrawing water from the subsurface, such as by use of a pump 22 or by use of air pressure or a submersible pump assembly for withdrawal of fluid samples from deeper wells. it is within the scope of the invention that the bore 19 itself be used as a conduit to convey the fluid samples to the surface.

As shown in the enlarged partial schematic view of FIG. 4, fluid samples are selectively drawn from the surrounding aquifer 21 through the central continuous wire-wound screened portion 12 of the hollow stem auger 11 and conveyed to the surface through the pipe means 20 positioned within the bore 19.

Thus, a hollow stem auger assembly is provided for the simultaneous drilling and testing of a well so as to detect and monitor the existence of hazardous and toxic waste at subsurface levels.

A lowermost vertically oriented screened hollow stem auger is provided which defines a longitudinal axial bore therethrough. The hollow stem auger has a central screened portion in open communication with said longitudinal axial bore so as to permit the selective intake of fluids into said bore from the surrounding aquifer. A plurality of vertically oriented solid wall hollow stem auger members are provided in end-to-end engagement with each other and with said lowermost screened hollow stem auger so as to provide a continuous hollow stem auger assembly to the upper ground surface. The interconnected hollow stem auger members thus define a continuous bore through said hollow stem auger assembly from the drilling level to the surface. Means in association with said hollow stem auger assembly are provided which are adapted to selectively draw fluid samples through said central screened portion of said lowermost screened hollow stem auger into said continuous bore for conveyance to the ground surface for testing purposes.

It is thus seen that a highly utilitarian apparatus and process is provided for continuously, quickly and economically detecting and monitoring hazardous and toxic waste that might be contained in subsurface unconsolidated formations and aquifers.

Various other modifications of the invention may be made without departing from the principle thereof. Each of the modifications is to be considered as included in the hereinafter appended claims, unless these claims by their language expressly provide otherwise.

I claim:

1. A vertically oriented screened hollow stem auger for use in the simultaneous drilling and testing of wells so as to detect and monitor the existence of hazardous and toxic waste at subsurface levels comprising:

an elongate cylindrical hollow stem body member defining a longitudinal axial bore therethrough, said body member having a central screened portion in open communication with the interior thereof so as to permit the selective intake of fluids into said bore, said body member having an upper end portion adapted for selective lockable end-to-end engagement with a vertical solid wall hollow stem auger element positioned thereabove, said body member having a lower end portion adapted for selective lockable engagement with a drilling component; and a continuous auger flight element provided on the external surface of the hollow stem body member so as to extend longitudinally therealong across said central screened portion, said central screened portion being the sole support of the portion of said auger flight element extending thereacross.

2. In the vertically oriented screened hollow stem auger of claim 1 wherein said upper end portion comprises a narrow tubular extension adapted for mating engagement with a lower socket portion provided on a solid wall hollow stem auger positioned thereabove.

3. In the vertically oriented screened hollow stem auger of claim 1 wherein said lower end portion is selectively provided with a closure plug element.

4. In the vertically oriented screened hollow stem auger of claim 1 wherein said central screened portion consists of a continuous wire wound screen element.

5. A hollow stem auger assembly positioned within a well for the simultaneous drilling and testing thereof so as to detect and monitor the existence of hazardous and toxic waste at subsurface levels comprising:

a lowermost vertically oriented screened hollow stem auger defining a longitudinal axial bore therethrough, said hollow stem auger having an auger flight element extending externally therealong, said hollow stem auger having a central screened portion in open communication with said longitudinal axial bore so as to permit the selective intake of fluids into said bore, said central screened portion being the sole support of the portion of said auger flight element extending thereacross;

a plurality of vertically oriented solid wall hollow stem auger members in end-to-end engagement with each other and with said lowermost screened hollow stem auger so as to provide a continuous hollow stem auger assembly to the upper ground surface, said interconnected hollow stem auger members defining a continuous bore through said hollow stem auger assembly; and means in association with said hollow stem auger assembly adapted to selectively draw fluid through said central screened portion of said lowermost screened hollow stem auger into said continuous bore for conveyance to the ground surface for testing purposes.

* * * * *